US008349169B2

(12) United States Patent
Osborne, III

(10) Patent No.: US 8,349,169 B2
(45) Date of Patent: Jan. 8, 2013

(54) METHOD AND APPARATUS FOR DECOKING TUBES IN AN OIL REFINERY FURNACE

(76) Inventor: Leslie D. Osborne, III, Pascagoula, MS (US)

( * ) Notice: Subject to any disclaimer, the term of this patent is extended or adjusted under 35 U.S.C. 154(b) by 1124 days.

(21) Appl. No.: 12/054,376

(22) Filed: Mar. 24, 2008

(65) Prior Publication Data

US 2008/0234868 A1 Sep. 25, 2008

Related U.S. Application Data

(60) Provisional application No. 60/896,851, filed on Mar. 23, 2007.

(51) Int. Cl.
*C10G 9/16* (2006.01)

(52) U.S. Cl. ..... 208/48 R; 196/107; 196/122; 196/132; 208/131

(58) Field of Classification Search ..... 208/48 R, 208/131; 196/107, 110, 116, 122, 132, 135; 201/2; 202/241, 151; 134/8, 10, 18, 22.12, 134/22.15; 422/62, 109, 119
See application file for complete search history.

(56) References Cited

U.S. PATENT DOCUMENTS

| | | | | | |
|---|---|---|---|---|---|
| 1,939,112 | A * | 12/1933 | Eulberg | 196/122 |
| 1,989,389 | A * | 1/1935 | Watts et al. | 208/131 |
| 2,316,931 | A * | 4/1943 | Brandt | 208/47 |
| 3,112,880 | A * | 12/1963 | Pollock | 236/20 R |
| 4,297,147 | A * | 10/1981 | Nunciato et al. | 134/7 |
| 4,792,436 | A * | 12/1988 | Tsai | 422/111 |
| 4,817,009 | A * | 3/1989 | Jensen et al. | 700/210 |
| 5,266,169 | A * | 11/1993 | Geary et al. | 196/122 |
| 5,891,310 | A | 4/1999 | Nelsen | |
| 6,187,147 | B1 | 2/2001 | Doerksen | |
| 6,769,411 | B2 | 8/2004 | Fabiani | |
| 6,852,294 | B2 * | 2/2005 | Doerksen | 422/200 |
| 7,597,797 | B2 * | 10/2009 | Gregory | 208/131 |
| 7,670,462 | B2 * | 3/2010 | Gibson et al. | 201/2 |
| 2004/0055579 | A1 | 3/2004 | Fabiani | |
| 2006/0076225 | A1 | 4/2006 | Lah | |

* cited by examiner

*Primary Examiner* — Jill Warden
*Assistant Examiner* — Joye L Woodard

(57) ABSTRACT

A control system for performing a global-decoke of a tube furnace comprising a plurality of passes.

10 Claims, 23 Drawing Sheets

COKE DRUM SCHEDULE
18 HOUR CYCLE

| TIME (HRS) | DRUM 1 | DRUM 2 | TIME (HRS) |
|---|---|---|---|
| 18 | COKE FILL | STEAMOUT | 1 |
| | | QUENCH | 4 |
| | | DRAIN | 1.5 |
| | | UNHEAD/PILOT HOLE | 1 |
| | | DRILL | 4.5 |
| | | REDHEAD | 0.5 |
| | | WARM-UP TEST | 5.5 |
| 1 | STEAMOUT | COKE FILL | 18 |
| 4 | QUENCH | | |
| 1.5 | DRAIN | | |
| 1 | UNHEAD/PILOT HOLE | | |
| 4.5 | DRILL | | |
| 0.5 | REDHEAD | | |
| 5.5 | WARM-UP TEST | | |

FIG. 2 (Prior Art)

| TABLE 1 | |
|---|---|
| AR(N) | Air regulator, *e.g.*, AR(1) regulates compressed air in Li(1) and thence routed through P(1) to burn off unwanted carbon coke deposits inside the tube of P(1), three-way valve 100 used to divert coke reaction products ( $CO_2$ and CO) and un-reacted coke flakes/deposits into the decoke system 180 |
| B(N) | Burner, *e.g.*, B(1) provides heat to furnace tube in P(1) |
| BR1 | Flow regulator BR(1) for directing fluid to decoke system 180 |
| BR2 | Flow regulator BR(2) in a coke bypass line |
| COL | Combined output line |
| FIR | Feed input rate through an input line which during normal operation petroleum residuum is fed to a pass in furnace tube 120. |
| FIR(N) | Feed input rate, *e.g.*, FIR(1) is the feed input rate through input line Li(1); FIR(1) data can be provided by FR(1), which regulates feed flow from Li(1) into P(1) |
| FGR(N) | Feed gas regulator, *e.g.*, FGR(1) regulates gas feed to B(1) to increase, decrease or maintain current temperature of the furnace tube in P(1) |
| FOT(N) | Feed outlet temperature in an output line as measured by OTC(N), *e.g.*, FOT(1) in Lo(1) is provided by output temperature device OTC(1) |
| FR(N) | Feed regulator, *e.g.*, FR(1) regulates petroleum residuum feed to P(1) via Li(1) |
| FTT(N) | Furnace tube temperature, *e.g.*, FTT(1) data can be provided by TT(1) a thermocouple device attached to a section of furnace tube in P(1) |
| global_decoke mode | decoking of all the passes, *i.e.*, decoking of all the furnace tubes in P(1 through N) in tube furnace 120. |
| Li(N) | Input line, *e.g.*, Li(1) provides petroleum residuum feed to P(1) |
| Lo(N) | Output line, *e.g.*, Lo(1) carries heated feed from P(1) |
| MATFR | Minimal acceptable total flow rate of feed into furnace 120 |
| MFM | Main flow meter on main input line carrying petroleum product such as, but not limited to: crude oil, residuum (feed), the main input line is split into input lines Li(1 through N) in which petroleum product is respectively delivered to P(1 through N) via input lines Li(1 through N) |
| OTC(N) | Output temperature measurement device such as a thermocouple, *e.g.*, OTC(1) measures the temperature of Lo(1); when feed is running through Lo(N) then the temperature of the feed FOT(N) in outlet line Lo(N) is provided by OTC(N). |
| P(N) | Pass # inside tube furnace 120, *e.g.*, P(1) refers to the furnace tube that makes up pass #1 |
| PA | Predetermined amount |

*FIG. 5A*

| TABLE 1 (CONTINUED) | |
|---|---|
| SIFR | Set input feed rate through a given input line delivering feed to a pass in furnace tube 120, each SIFR is allocated, meaning each pass is allocated its own SIFR – but the SIFRs for all the passes can be set to a selected equal (common) SIFR. |
| SIFR(N) | Set input feed rate, *i.e.*, the minimum amount of feed required to be delivered through an input line Li(N) to furnace tube in P(N). |
| SP(N) | Set point, a predetermined acceptable temperature or acceptable temperature range in an output line, *e.g.*, SP(1) is the predetermined acceptable temperature for heated feed in Lo(1). |
| SR(N) | Steam regulator, *e.g.*, SR(1) regulates steam in Li(1) and thence routed through P(1) to chemically remove unwanted carbon coke deposits inside the tube of P(1); steam is generally forced through furnace tubes prior to pumping air into the furnace tubes; three-way valve 100 used to divert coke reaction products (*e.g.*, CO) and un-reacted coke flakes/deposits into the decoke system 180 |
| TFR | Total flow rate TFR – measured by MFM – which is equivalent to the sum total flow rate of feed into P(1 through N), hence total flow rate of feed into and out of tube furnace 120 |
| TP(N) | Trigger point, the point at which a tube in a pass is at its maximum permitted safe operating temperature, *e.g.*, TP(1) is the trigger point for the furnace tube in P(1) of tube furnace 120. |
| TT(N) | Tube temperature measurement device such as a radiation protected thermocouple connected to a section of a tube in P(N), wherein the tube temperature measurement device TT(N) provides data FTT(N), *e.g.*, TT(1) provides the furnace tube temperature FTT(1) in P(1). TT(N) also provide temperature feedback during an air purge of the furnace tubes wherein the tube temperature measurement device is used to monitor for a temperature spike which happens when the air and coke deposits react exothermically thereby signaling that the remaining carbon coke deposits on the inner tube walls of the furnace tubes is combusting using the oxygen in the air as the oxidation source, the spontaneous ignition provided by ensuring sufficient hot temperature inside the furnace tube by monitoring with infra-red cameras and/or tube temperature measurement device inside each pass. |
| 100 | 3-way valve 100 |
| 105 | 4-way valve 105 |
| 115 | Delayed coke bypass line 115 |

*FIG. 5B*

| TABLE 1 (CONTINUED) | |
|---|---|
| 120 | Tube furnace 120 |
| 140 | First delayed coke drum 140 |
| 160 | Second delayed coke drum 160 |
| 180 | decoke system 180 |
| 190 | Coke bypass line |
| 200 | Block 200 in flow chart shown in Figure 6 |
| 220 | Block 220 in flow chart shown in Figure 6 |
| 240 | Block 240 in flow chart shown in Figure 6 |
| 260 | Block 260 in flow chart shown in Figure 6 |
| 280 | Block 280 in flow chart shown in Figure 7 |
| 285 | Block 285 in flow chart shown in Figure 7 |
| 290 | Control system 290 |
| 300 | Main controller 300 |
| 320 | Block 320 in flow chart shown in Figure 11 |
| 340 | Block 340 in flow chart shown in Figure 11 |
| 360 | Block 360 in flow chart shown in Figure 18 |
| 380 | Block 380 in flow chart shown in Figure 18 |

*FIG. 5C*

```
DO WHILE
  Repeatedly perform the following DO LOOP so long as the number of passes that meet or
  exceed their allocated SIFR does not fall below a predetermined number
    DO N=1,number_of_passes
        IF {FOT(N) < SP(N) AND FTT(N) < TP(N) AND FIR(N) ≥ SIFR(N)} THEN
          Increase FTT(N), e.g., main-controller 300 sends a control signal to FGR(N) to
            increase fuel gas flow to B(N) by a predetermined amount
        ELSEIF {FOT(N) < SP(N) AND FTT(N) < TP(N) AND FIR(N)< SIFR(N)} THEN
          Increase FTT(N) (e.g., main-controller 300 sends a control signal to FGR(N) to
            increase fuel gas flow to B(N) by a predetermined amount
            Increase FIR(N) (e.g., send a control-signal to feed-controller to increase FIR(N) by
              a predetermined amount)
        ELSEIF {FOT(N) > SP(N) AND FTT(N) < TP(N) AND FIR(N)≥ SIFR(N)} THEN
            Decrease FTT(N), e.g., main-controller 300 sends a control-signal to FGR(N) to
            decrease fuel gas flow to B(N) by a predetermined amount)
        ELSEIF {FOT(N) > SP(N) AND FTT(N) < TP(N) AND FIR(N)< SIFR(N)} THEN
            Increase FIR(N) (e.g., main-controller 300 sends a control signal to feed-controller
              to increase FIR(N) by a predetermined amount)
        ELSEIF {FOT(N) > SP(N) AND FTT(N) ≈ TP(N) AND FIR(N)≥ SIFR(N) } THEN
            Decrease FTT(N), e.g., main-controller 300 sends a control-signal to FGR(N) to
              decrease fuel gas flow to B(N)
        ELSEIF { (FOT(N) ≈ SP(N) OR FOT(N)> SP(N)) AND ((FTT(N) ≈ TP(N)) OR
          (FTT(N) ≥ TP(N))) AND ((FIR(N)≈ SIFR(N)) OR  (FIR(N)> SIFR(N))) } THEN
            Decrease FTT(N) and initiate procedure to perform online steam spalling decoke of
              the furnace tube in P(N)
        ELSE
            No Change
        ENDIF
    END DO
ENDWHILE
```

If deemed appropriate, *e.g.*, not cancelled by operator staff, then main controller 300 initiates procedure to perform global_decoke firstly by steam spalling all furnace tubes in all passes, *e.g.*, by controllably shutting all feed regulators, *i.e.*, main-controller 300 closes FR(1 through N), and opens SR(1 through N) to steam-out furnace tubes in P(1 through N) and main-controller 300 directs a control signal to the three-way valve 100 to direct output from the COL to the decoke system 180; after a predetermined amount of time main-controller 300 opens AR(1 through N) to complete the decoking of P(1 through N); air can be added one pass at a time but given the level of control provided by block 280, this can be done be air-steam or air alone decoking by pairs of passes, *e.g.*, for a four pass furnace P(1 and 2) then P(3 and 4)

280

285

*FIG. 7*

| TABLE 2 (please refer to logic block 280) | | | |
|---|---|---|---|
| Number of Passes in furnace | Predetermined number | Number of passes that do not meet or exceed their allocated SIFR* | Global_Decoke of furnace |
| 6 | 2 | 3[1] | No |
| 6 | 4 | 3[2] | Yes |
| 4 | 3 | 1 | No |
| 4 | 3 | 2 | Yes |

*Possibly because of online steam spalling of passes

[1] Therefore, 3 passes are meeting or exceeding their allocated SIFR thus exceeding the predetermined number of passes with allocated FIR ≥ allocated SIFR

[2] Therefore, 3 passes are meeting or exceeding their allocated SIFR which is not enough to satisfy the predetermined number of passes with allocated FIR ≥ allocated SIFR

FIG. 10

```
DO WHILE
  Repeatedly perform the following DO LOOP so long as the number of passes that meet or
  exceed their allocated SIFR does not fall below a predetermined number
    DO N=1,number_of_passes
        IF {FOT(N) < SP(N) AND FTT(N) < TP(N) AND FIR(N) ≥ SIFR(N)} THEN
          Increase FTT(N), e.g., main-controller 300 sends a control signal to FGR(N) to
            increase fuel gas flow to B(N) by a predetermined amount
        ELSEIF {FOT(N) < SP(N) AND FTT(N) < TP(N) AND FIR(N)< SIFR(N)} THEN
          Increase FTT(N) (e.g., main-controller 300 sends a control signal to FGR(N) to
            increase fuel gas flow to B(N) by a predetermined amount
            Increase FIR(N) (e.g., send a control-signal to feed-controller to increase FIR(N) by
              a predetermined amount)
        ELSEIF {FOT(N) > SP(N) AND FTT(N) < TP(N) AND FIR(N)≥ SIFR(N)} THEN
            Decrease FTT(N), e.g., main-controller 300 sends a control-signal to FGR(N) to
            decrease fuel gas flow to B(N) by a predetermined amount)
        ELSEIF {FOT(N) > SP(N) AND FTT(N) < TP(N) AND FIR(N)< SIFR(N)} THEN
            Increase FIR(N) (e.g., send a control-signal to feed-controller to increase FIR(N) by
              a predetermined amount)
        ELSEIF {FOT(N) > SP(N) AND FTT(N) ≈ TP(N) AND FIR(N)≥ SIFR(N) } THEN
            Decrease FTT(N), e.g., main-controller 300 sends a control-signal to FGR(N) to
              decrease fuel gas flow to B(N)
        ELSEIF { (FOT(N) ≈ SP(N) OR FOT(N)> SP(N)) AND ((FTT(N) ≈ TP(N)) OR
          (FTT(N) ≥ TP(N))) AND ((FIR(N)≈ SIFR(N)) OR  (FIR(N)> SIFR(N))) } THEN
            Decrease FTT(N) and initiate procedure to perform online steam spalling decoke of
              the furnace tube in P(N)
        ELSE
            No Change
        ENDIF
    END DO
ENDWHILE
```

If deemed appropriate, *e.g.*, not cancelled by operator staff, then main-controller 300 initiates procedure to perform global_decoke firstly by steam spalling all furnace tubes in all passes, *e.g.*, by controllably shutting all feed regulators, *i.e.*, FR(1 through N), and opening SR(1 through N) to steam-out furnace tubes in P(1 through N) and direct a control signal from the main-controller 300 to the four-way valve 105 and BR1 (with BR2 closed) to direct output from the COL to the decoke system 180; after a predetermined amount of time open AR(1 through N) to complete the decoking of P(1 through N); air can be added one pass at a time, this can be done be air-steam or air alone decoking by pairs of passes, *e.g.*, for a four pass furnace P(1 and 2) then P(3 and 4)

320

340

*FIG. 11*

```
DO WHILE
  Repeatedly perform the following DO LOOP so long as the number of passes that meet or
  exceed their allocated SIFR does not fall below a predetermined number
    DO N=1,number_of_passes
        IF {FOT(N) < SP(N) AND FTT(N) < TP(N) AND FIR(N) ≥ SIFR(N)} THEN
          Increase FTT(N), e.g., main-controller 300 sends a control signal to FGR(N) to
            increase fuel gas flow to B(N) by a predetermined amount
        ELSEIF {FOT(N) < SP(N) AND FTT(N) < TP(N) AND FIR(N)< SIFR(N)} THEN
          Increase FTT(N) (e.g., main-controller 300 sends a control signal to FGR(N) to
            increase fuel gas flow to B(N) by a predetermined amount
            Increase FIR(N) (e.g., send a control-signal to feed-controller to increase FIR(N) by
              a predetermined amount)
        ELSEIF {FOT(N) > SP(N) AND FTT(N) < TP(N) AND FIR(N)≥ SIFR(N)} THEN
            Decrease FTT(N), e.g., main-controller 300 sends a control-signal to FGR(N) to
            decrease fuel gas flow to B(N) by a predetermined amount)
        ELSEIF {FOT(N) > SP(N) AND FTT(N) < TP(N) AND FIR(N)< SIFR(N)} THEN
            Increase FIR(N) (e.g., send a control-signal to feed-controller to increase FIR(N) by
              a predetermined amount)
        ELSEIF {FOT(N) > SP(N) AND FTT(N) ≈ TP(N) AND FIR(N)≥ SIFR(N) } THEN
            Decrease FTT(N), e.g., main-controller 300 sends a control-signal to FGR(N) to
              decrease fuel gas flow to B(N)
        ELSEIF { (FOT(N) ≈ SP(N) OR FOT(N)> SP(N)) AND ((FTT(N) ≈ TP(N)) OR
          (FTT(N) ≥ TP(N))) AND ((FIR(N)≈ SIFR(N)) OR  (FIR(N)> SIFR(N))) } THEN
            Decrease FTT(N) and initiate procedure to perform online steam spalling decoke of
              the furnace tube in P(N)
        ELSE
            No Change
        ENDIF
    END DO
ENDWHILE
```

If deemed appropriate, *e.g.*, not cancelled by operator staff, then main-controller 300 initiates procedure to perform global_decoke firstly by steam spalling all furnace tubes in all passes, *e.g.*, by controllably shutting all feed regulators, *i.e.*, FR(1 through N), and opening SR(1 through N) to steam-out furnace tubes in P(1 through N) and direct a control signal from the main-controller 300 to the four-way valve 105 to direct output from the COL to the decoke system 180; after a predetermined amount of time open AR(1 through N) to complete the decoking of P(1 through N); air can be added one pass at a time, this can be done be air-steam or air alone decoking by pairs of passes, *e.g.*, for a four pass furnace P(1 and 2) then P(3 and 4)

360

380

*FIG. 18*

METHOD AND APPARATUS FOR DECOKING TUBES IN AN OIL REFINERY FURNACE

CROSS-REFERENCE TO RELATED APPLICATIONS

This application claims the benefit of priority from U.S. Provisional Patent Application Ser. No. 60/896,851 (filed Mar. 23, 2007), which is incorporated herein by reference in its entirety.

STATEMENT REGARDING FEDERALLY SPONSORED RESEARCH OR DEVELOPMENT

Not Applicable.

FIELD OF THE INVENTION

This invention generally relates to removing coke, in the form of coke-buildup, from the interior tube walls of a multi-pass oil refinery tube furnace, which finds wide usage in various places in an oil refinery.

BACKGROUND OF THE INVENTION

Coking up of furnace tubes in multi-pass oil furnace tubes is a problem that impacts on the day-to-day operations of a typical oil refinery. For example, in the delayed coking process, a petroleum residuum (also referred to as "feed") is heated to coking temperature in a tube furnace, and the heated residuum is then passed to a coking drum (often referred to as a "delayed coking drum") where the heated residuum decomposes into volatile components and delayed coke. The delayed coking process has been used for several decades, primarily as a means of producing useful products from the low value residuum of a petroleum refining operation.

Coker furnaces typically include multiple banks of furnace tubes; banks of furnace tubes are often referred to as "passes". Two or more passes are typical, e.g., a four pass tube furnace. Each bank of furnace tubes is heated by a burner such as a gas fired heater. For example, a tube furnace with four passes would typically have four independently controlled burners, i.e., one burner per pass. Typically, each burner is controlled by a gas-controller for controlling the amount of gas fed to the burner thereby allowing individual control over the furnace tube temperature of each pass.

The tube furnace heats feed in the form of high boiling petroleum residues to a suitable temperature of about 900° F. The heated feed is directed to a delayed coke drum. During normal operation of the tube furnace the furnace tube of each pass becomes fouled by coke deposits on the interior surface of the tubes. As this fouling process progresses, the furnace efficiency drops, and progressively more severe furnace conditions are required to heat the incoming feed to coking temperature. As a result of this internal furnace tube fouling, it is necessary to periodically decoke the furnace tubes.

A similar problem occurs in multi-pass oil refinery tube furnaces used to heat crude oil prior to entry into downstream fractionator plant, and petroleum oil furnaces used to heat petroleum feed to be fed into downstream vacuum distillation plant; all these tube furnaces, which typically comprise of a plurality of passes ("multi-pass oil refinery furnaces") can experience coke build up on the inner surfaces of the tubes thereby necessitating some form of decoking process to remove the coke built up inside the furnace tubes of each pass.

There are several methods used to decoke the furnace tubes. In some procedures, the furnace is taken out of service during the decoking procedure. In other procedures, only a part of the tube banks are removed from service. In all cases, production is either halted or reduced during the furnace decoking process.

One decoking procedure, sometimes referred to as online steam spalling involves injecting high velocity steam or water and cycling the furnace tube temperature enough, such as between about 1000° F. and about 1300° F., to cause contraction and expansion of the tube, with resultant flaking off of the accumulated coke deposits. The deposits are then blown from the furnace tubes by steam flow. This procedure can be carried out on a portion of the tube banks while another portion of the tube banks remains in production sending heated feed to the pair of delayed coke drums, one of which receives the heated feed in accordance to their batch-continuous mode of operation.

Another decoking procedure involves injection of air along with the steam at some stage of the decoking; it is also possible to gradually increase the amount of air in the steam until just air is being injected into the furnace tubes, usually one pass at a time because of the risk of overheating and costly damage to furnace tubes. Because the tubes are still very hot during the decoking, the air combusts the coke deposits, such that there is combustion of coke.

In more detail, in a typical oil refinery coking process, feed in the form of high boiling petroleum residues is heated in a furnace to a temperature of typically about 900° F. to provide heated feed which is then fed to one or more coke drums (often called delayed coke drums). A pair of coke drums are alternately filled and emptied, with heated feed being pumped into one of the drums while the other drum is being emptied of coke and prepared for the next filling cycle.

In a typical batch-continuous coking process a coker-module comprises a first coke drum and a second coke drum (respectively labeled as "DRUM 1" and "DRUM 2" in prior art FIG. 1), which operate in parallel such that when the first coke drum is online and being filled with heated feed from a tube furnace (labeled as "DCD Tube Furnace" in prior art FIG. 1), the second coke drum is being decoked to purge and harvest the manufactured coke contained therein. Thereafter, when the first delayed coke drum has reached capacity, the heated feed is switched to the second coke drum that has just previously been purged of its contents, and first coke drum is primed for the decoking process where its contents are purged and harvested. This cyclical process is commonly referred to as batch-continuous or continuous-batch operation.

As noted in U.S. Pat. No. 5,891,310 typical delayed coke drum cycle time is around 18 hours (see prior art FIG. 2) though shorter or longer cycle times are possible depending on the specification of the plant equipment and commercial operation requirements. With the exception of interruptions for events such as maintenance shutdowns, the continuous-batch mode of operation allows a refinery to maintain continuous-batch operation.

Interruptions to the cyclical continuous-batch process described above can occur if the furnace supplying heated feed is shutdown for maintenance. For example, furnaces are shutdown as a result of coke-buildup inside the furnace tubes. Mild coke-buildup occurs in the furnace tubes as oil feed is heated in the tubes. Coke-buildup inside the furnace tubes reduces the operating performance of the furnace.

To achieve normal furnace performance a decoking procedure is carried out. One way of decoking furnace-tubes is steam spalling in which steam is forced through the furnace tubes to remove coke-buildup from the furnace tubes.

Since decoking a furnace can lead to interruptions in the cyclical batch-continuous process there is a need to decoke furnaces in a timely and efficient manner.

SUMMARY

A control system for performing a global-decoke of a tube furnace comprising a plurality of passes.

BRIEF DESCRIPTION OF THE DRAWINGS

FIGS. 1 and 2 respectively show prior art renditions of an oil refinery and a delayed coke drum schedule.

FIGS. 5A through 5C show Table 1.

FIGS. 6 and 7 show each show a flow chart according to one embodiment of the present invention.

FIG. 10 shows Table 2.

FIG. 11 shows a flow chart depicting a further aspect of the present invention.

FIG. 18 shows a flow chart depicting a further aspect of the present invention.

DETAILED DESCRIPTION OF THE INVENTION

This invention is directed to removing coke buildup from the interior tube walls of a multi-pass oil refinery tube furnace of the type used in an oil refinery to heat some kind of petroleum product such as, but not limited to, crude oil, petroleum residuum, etc. Hence, this invention speaks to the decoking of a multi-pass oil refinery tube furnace which is typically found in various locations in an oil refinery.

Figure 3:
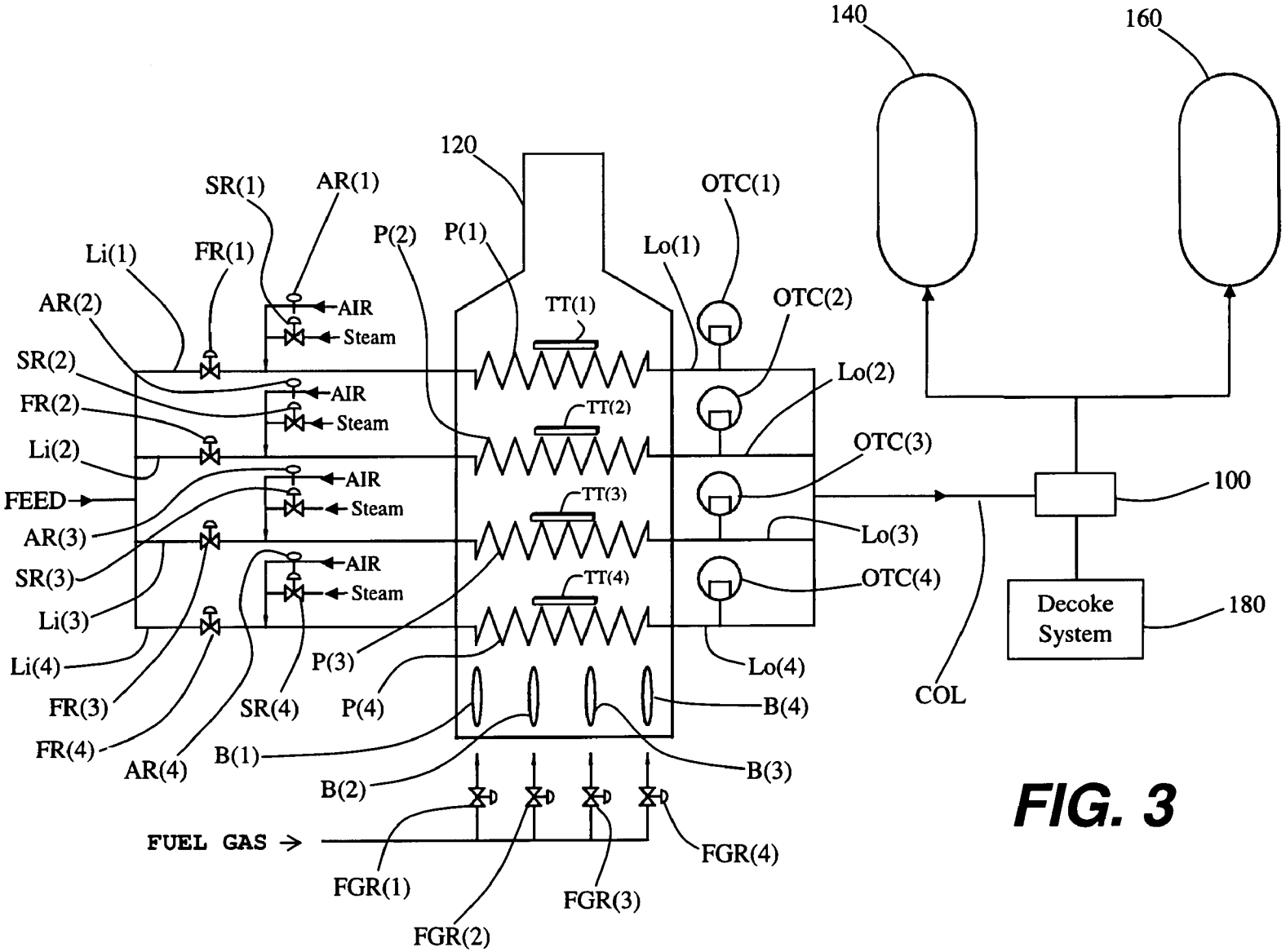
FIG. 3 shows a not-to-scale schematic layout of the first embodiment according to the present invention.

Referring now to FIG. 3 and onwards with regard to which the meaning of labels and numbers shown in the Figures are described in Table 1 (see FIGS. 5A through 5C).

FIG. 3 shows a not-to-scale schematic layout of the first embodiment of the present invention in which a 3-way valve 100 is deployed immediately downstream of a tube furnace 120 and is used to direct removed carbon deposits in the combined output line COL to the decoke system 180 (e.g., during decoke operations) or to direct heated feed (a petroleum product) to the delayed coke plant as represented respectively by first and second coke drums 140 and 160, which operate in batch-continuous mode. The tube furnace 120 is shown made up of plurality of passes, in this example of a tube furnace there are four passes, i.e., passes P(1) through P(4). It should be understood that the number of passes in the tube furnace 120 can vary, can be more than four or can be less than four. Explanation of the part numbers and labels shown in FIG. 3 are found in Table 1. The term "multi-pass" and "plurality of passes" are regarded as equivalent terms.

Figure 1:
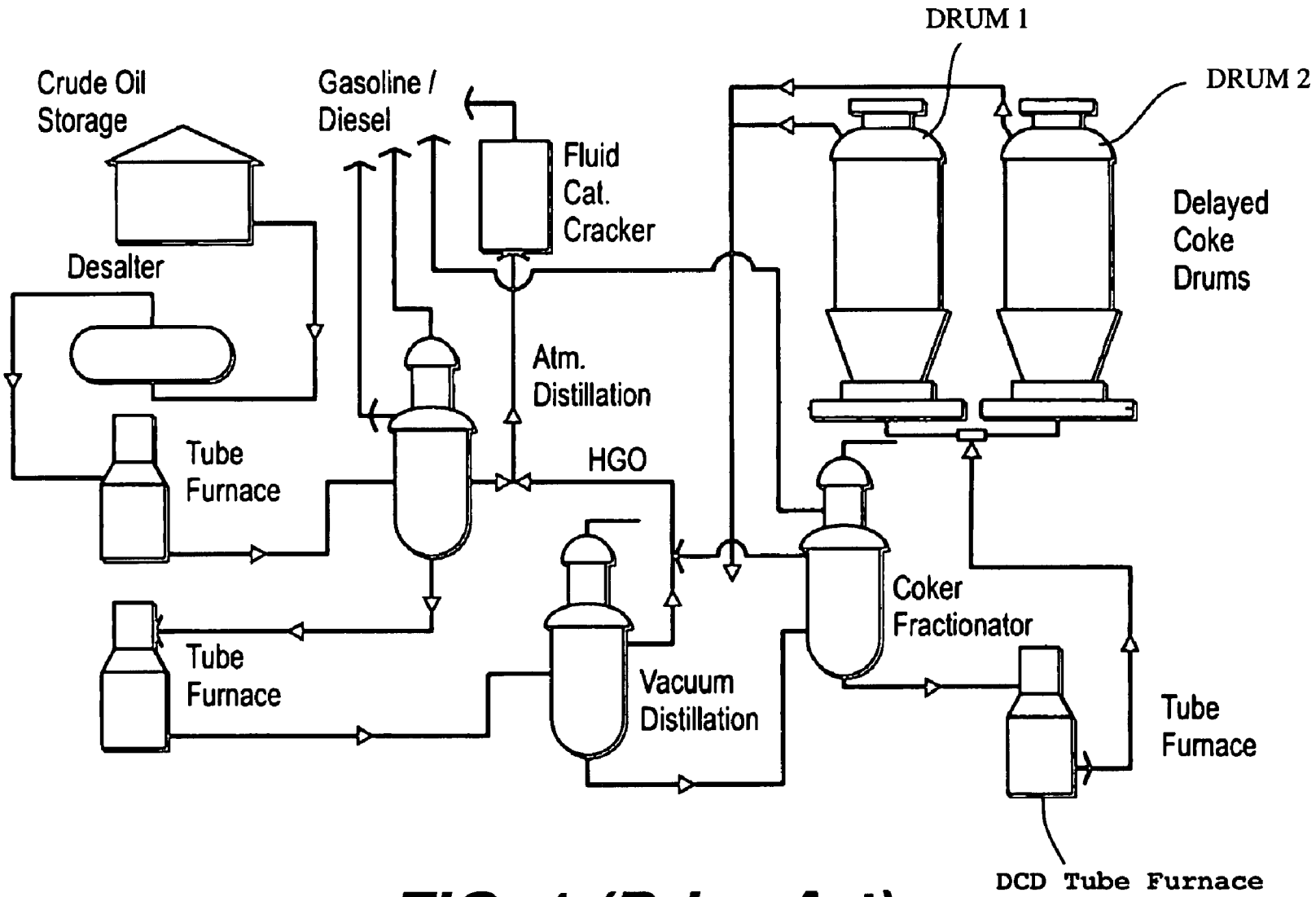
FIG. 1 (Prior Art)

It should be expressly understood that the present invention is not limited to multi-pass oil refinery furnaces located upstream of delayed coke drums. Every embodiment of the invention described in this paper speaks to a multi-pass tube furnace that is widely used in the oil refining industry to, for example, heat a petroleum product such as, but not limited to, crude oil or petroleum residuum. For example, the present invention can be equally applied to decoke a multi-pass tube oil furnace located upstream of a vacuum distillation plant or an oil fractionator plant (see, e.g., FIG. 3B) or a multi-pass tube furnace downstream of a crude oil storage tank where the multi-pass tube furnace is used to heat the crude oil. Essentially, the present invention speaks to any multi-pass oil tube furnace where there is a risk of coke build up on the inside of the tubes of the passes inside the multi-pass tube furnace (see FIG. 1 which shows "tube furnaces" at a variety of locations in an oil refinery, wherein the "tube furnace" can be a multi-pass oil tube furnace such as tube furnace 120 (see, e.g., FIG. 3A).

Figure 4:
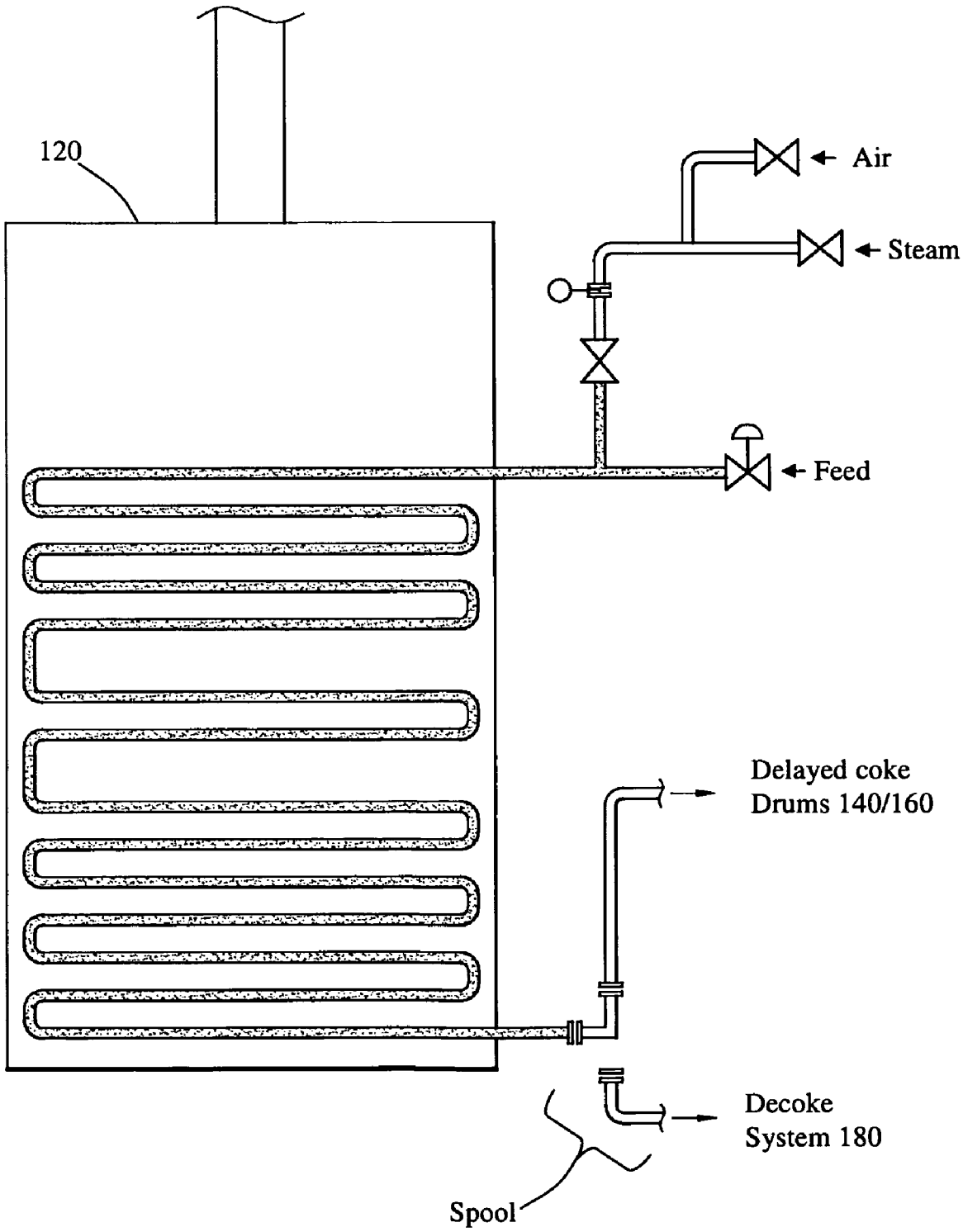
FIG. 4 (Prior Art)
FIG. 4 shows a prior art schematic featuring a prior art spool.

Still referring to FIG. 3, during normal operation heated feed is supplied to the delayed coke drums via three-way valve 100. Because the three-way valve 100 is directly downstream of the tube furnace 120 all the passes in the furnace 120 can be decoked simultaneously by switching the three-way valve 100 to direct the contents flowing along the combined output line COL to a decoke system 180 without first having to let the tube furnace 120 to cool down to a predetermined temperature low enough to allow human operators to physically interact with the tube furnace 120 to remove a heavy spool (see prior art FIG. 4) before directing fluid flow from the tube furnace into the decoke system 180.

Previously, refinery operators lost several hours of production while allowing the furnace to cool sufficiently to allow safe removal of the spool. However, as noted previously, the location of the multi-pass tube oil furnace is not critical, the apparatus and methodology of all the embodiments described in this application apply equally to multi-pass tube furnaces that are used to heat crude oil, to heat petroleum feed for use in, fore example, vacuum distillation, fractionation, etc. (see, e.g. FIG. 3B).

Figure 3A:
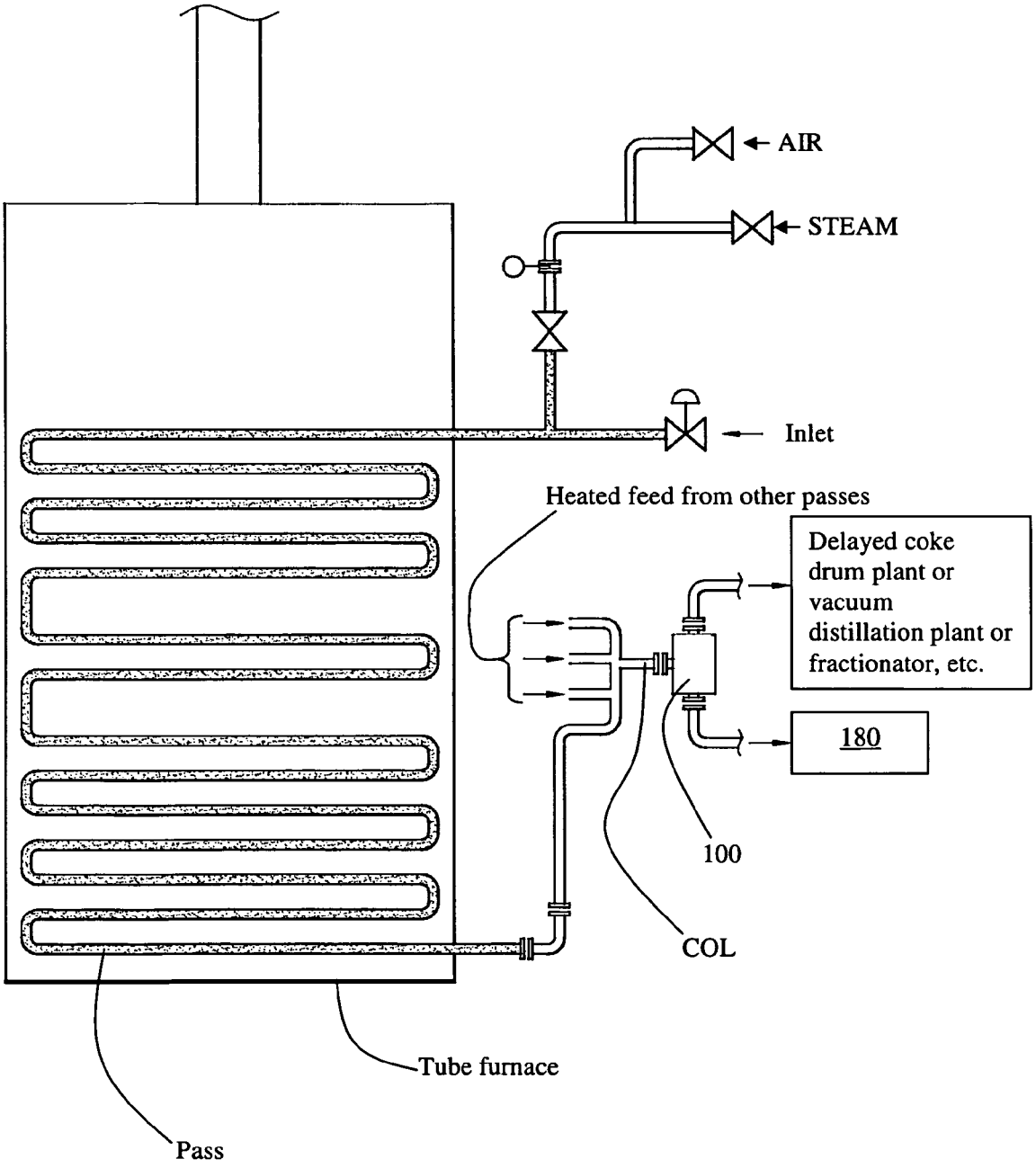
FIG. 3A shows a schematic view of a tube furnace according to the present invention.
Figure 3B:
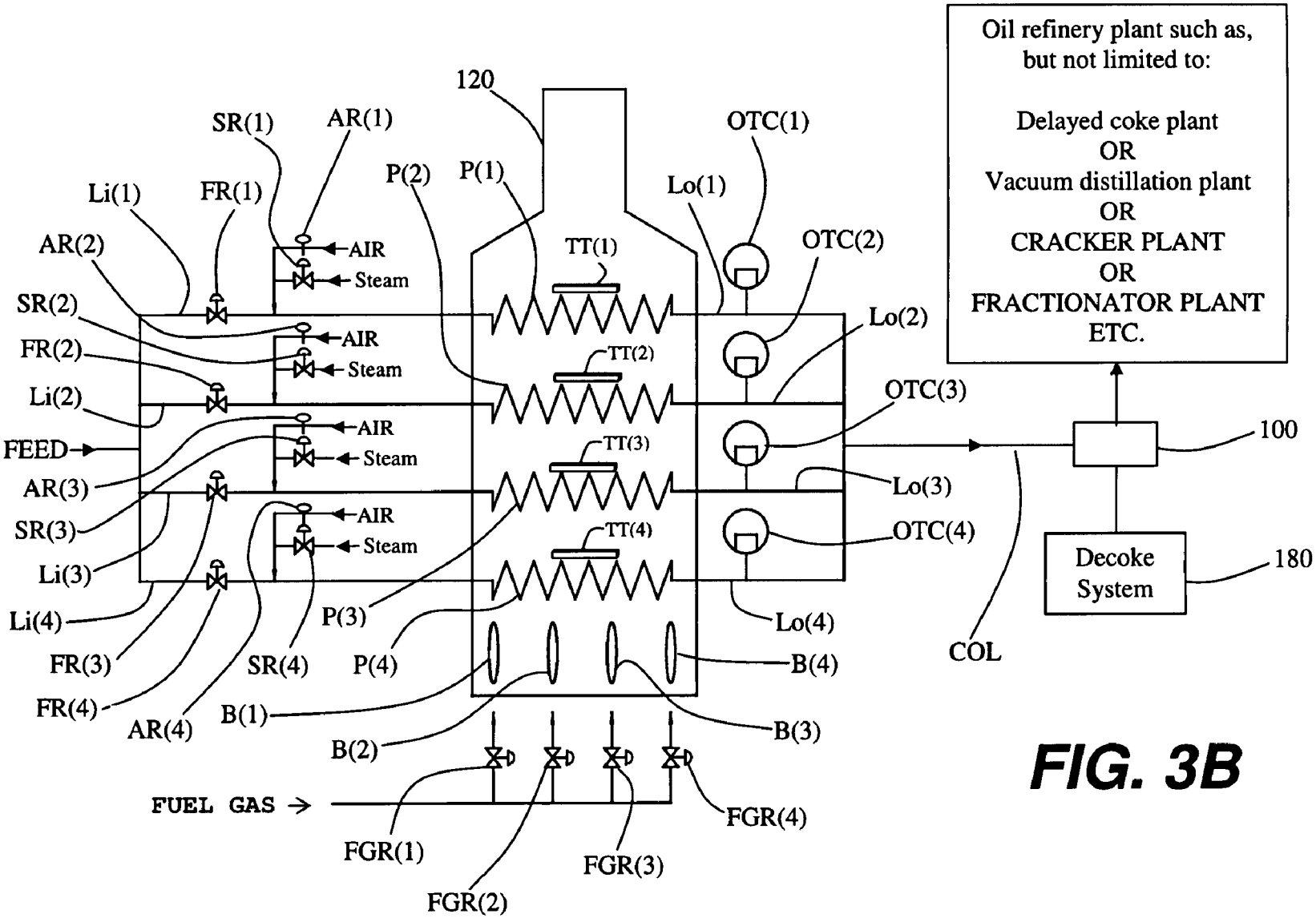
FIG. 3B shows a not-to-scale schematic layout of a further aspect of the present invention.

FIG. 3A shows a schematic view of a tube furnace with feed from four passes merging and being directed to a three-way valve 100. Explanation of the part numbers and labels shown in FIG. 3 are found in Table 1.

In the first embodiment of the present invention, the furnace 120 continues operating so long as the number of passes that meet or exceed their allocated SIFR does not fall below a predetermined number (see Table 1 for meaning of terms). For example, for a furnace with 4 passes and a predetermined number of 2, the furnace is automatically put into global-decoke mode (i.e., decoke of all four passes) once 3 passes are undergoing online steam spalling. For example, for a furnace with 6 passes and a predetermined number of 4, and P(1), P(3) and P(5) have associated FIR(1), FIR(3) and FIR(5) respectively less than SIFR(1), SIFR(3) and SIFR(5) the furnace is automatically put into global-decoke mode; this would occur, for example, if P(1, 3, and 5) are undergoing online steam spalling. Table 2 shows other examples where global-decoke is initiated (Table 2 is found in FIG. 10).

The terms "global_decoke" and "global-decoke" are regarded in this paper as equivalent terms. For meaning of terms used in this patent application please refer to Table 1 (found in FIGS. 5A through 5C).

Figure 6:
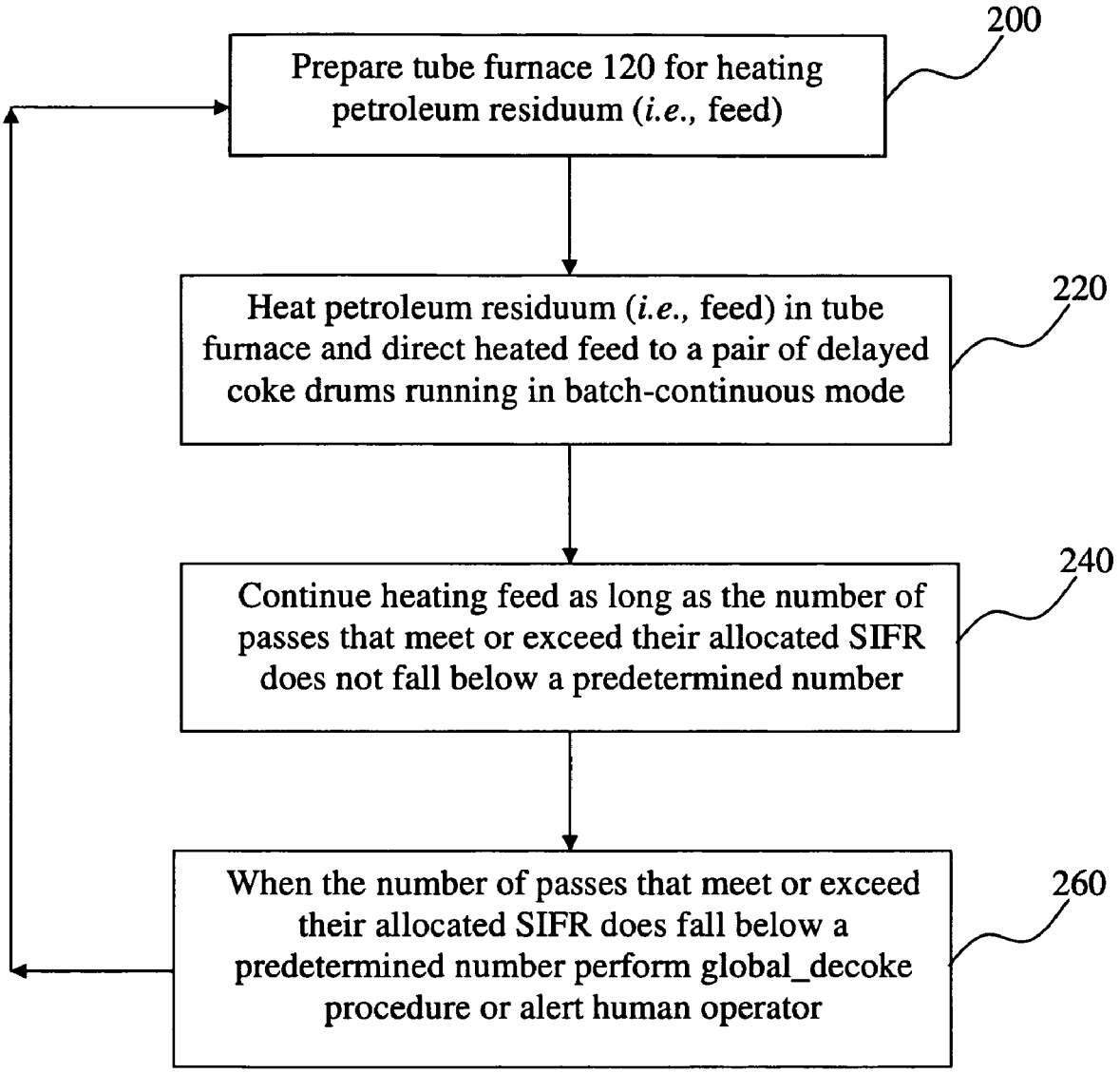

Referring to FIG. 6, which shows a block flow chart of one embodiment of the present invention, at block 200 the tube furnace 120 is prepared for operational mode by purging furnace tube lines. Once the purge is complete the three-way valve 120 directs flow to the pair of delayed coke drums 140 and 160 (see FIG. 3). The passes can be brought on line in series of batches of 2 or more, or all the passes can be brought on line depending on human operator preference or plant design limits.

Still referring to FIG. 6, at block 220 the petroleum residuum is heated in the furnace 120. As indicated in block 240, this continues as long as the number of passes that meet or exceed their allocated SIFR does not fall below a predetermined number. As indicated by block 260, when the number of passes that meet or exceed their allocated SIFR does fall below a predetermined number a global-decoke procedure is initiated. In the alternative, an alert is communicated, for example, to a human operator letting the operator know when the number of passes that meet or exceed their allocated SIFR has fallen below a predetermined number. Explanation of the part numbers and labels shown in FIG. 6 are found in Table 1.

Referring to FIG. 7, which shows logic blocks 280 and 285 that describe a series of logic steps for controlling the heating of feed in tube furnace 120 via input lines Li(1 through N) so long as the number of passes that meet or exceed their allocated SIFR does not fall below a predetermined number. Blocks 280 and 285 can be used respectively in place of blocks 240 and 260 in FIG. 6. Example outcomes generated by the logic steps in block 280 are shown in Table 2. Explanation of the part numbers and labels shown in FIG. 7 are found in Table 1.

Figure 8:
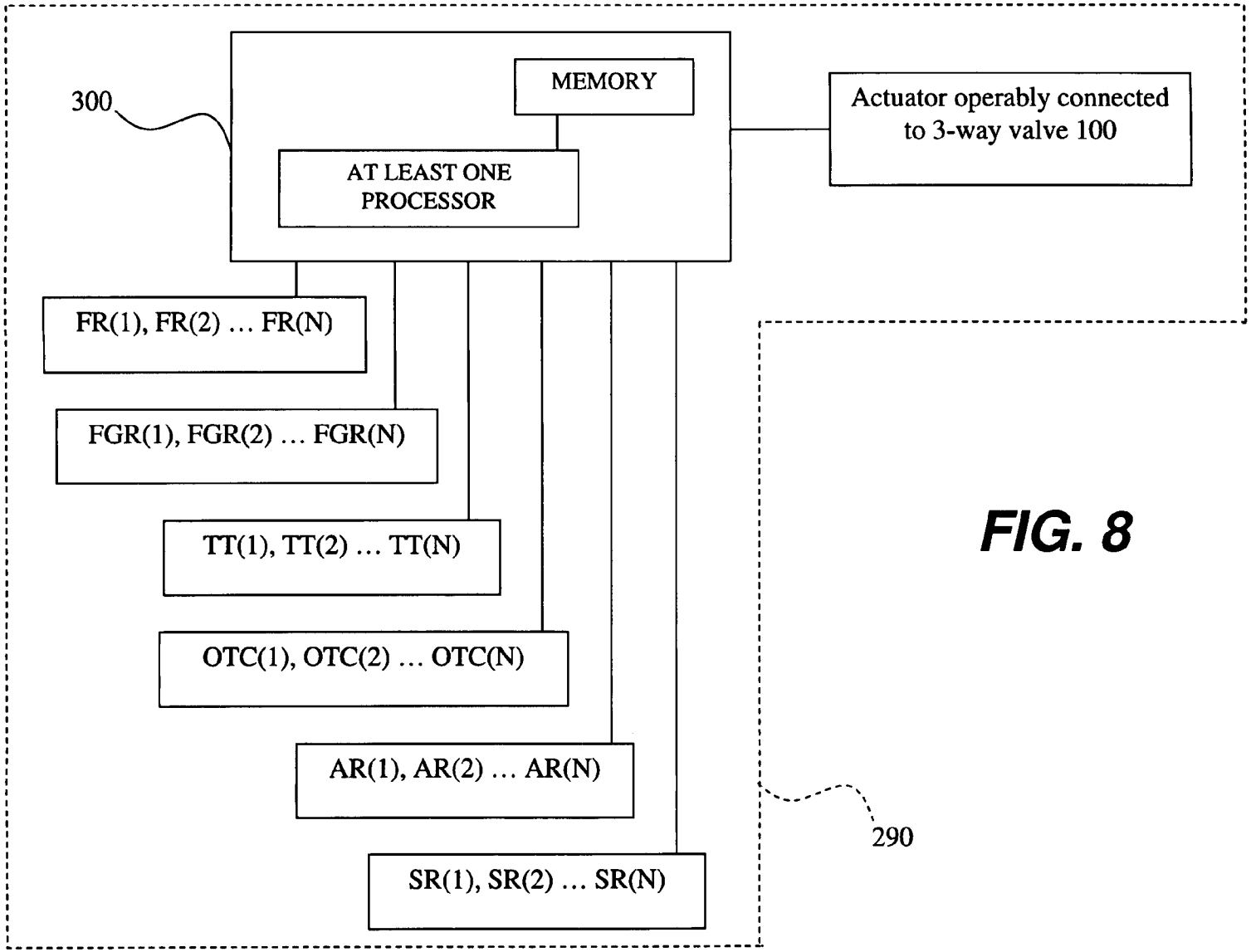
FIG. 8 shows a schematic diagram of a control system according to the present invention.

FIG. 8 shows a schematic diagram of a control system 290. The control system 290 comprises a main-controller 300. The main-controller 300 is operably connected either wirelessly and/or by hard line connections to: feed regulators FR(N), feed gas regulators FGR(N), air regulators AR(N), steam regulators SR(N), tube temperature measurement devices TT(N), output temperature measurement devices OTC(N), and 3-way valve 100. The main-controller 300 includes at least one processor and sufficient memory to perform a control algorithm, wherein the main-controller 300 operates in response to the control algorithm, wherein the control algorithm includes the logic steps necessary to selectively operate the three-way valve 100 and other parts of the control system 290 in order to perform, for example, the steps defined in blocks 280 and 285 as shown in FIG. 7. The memory may include random access memory (RAM), read only memory (ROM), and/or erasable programmable ROM (EPROM).

The main-controller 300, which forms part of control system 290, obtains feed input rate data FIR(N) from corresponding feed regulators FR(N), temperature date from tube temperature measurement devices TT(N) and output feed temperature measurement devices OTC(N). Using this date the main-controller 300 performs logic steps such as those defined in blocks 280 and 285 to selectively operate feed regulators FR(N), feed gas regulators FGR(N), air regulators AR(N), steam regulators SR(N), and the 3-way valve 100, which upon execution of block 285 switches the three-way valve 100 to direct the contents flowing along the combined output line COL to a decoke system 180. Thus, a hot spool (see FIG. 4) does not have to be cooled and removed, i.e., the present invention allows a complete decoke of the furnace 120 (i.e., the furnace tubes in P(1 through N) without first having to let the passes in furnace 120 cool sufficiently to allow human operators to remove the heavy spool before directing flow to the decoke system 180.

The main-controller 300 enables global-decoke of all passes to be performed without the prior art requirement of spending time for a cool down of the furnace sufficient to allow safe manual removal of a spool. The time saved leads to valuable productivity gains by reducing the time to decoke all the furnace tubes in every pass of the furnace 120 thereby reducing the time to get the furnace 120 back online and sending heated feed to the downstream pair of delayed coke drums 140 and 160.

Figure 9:
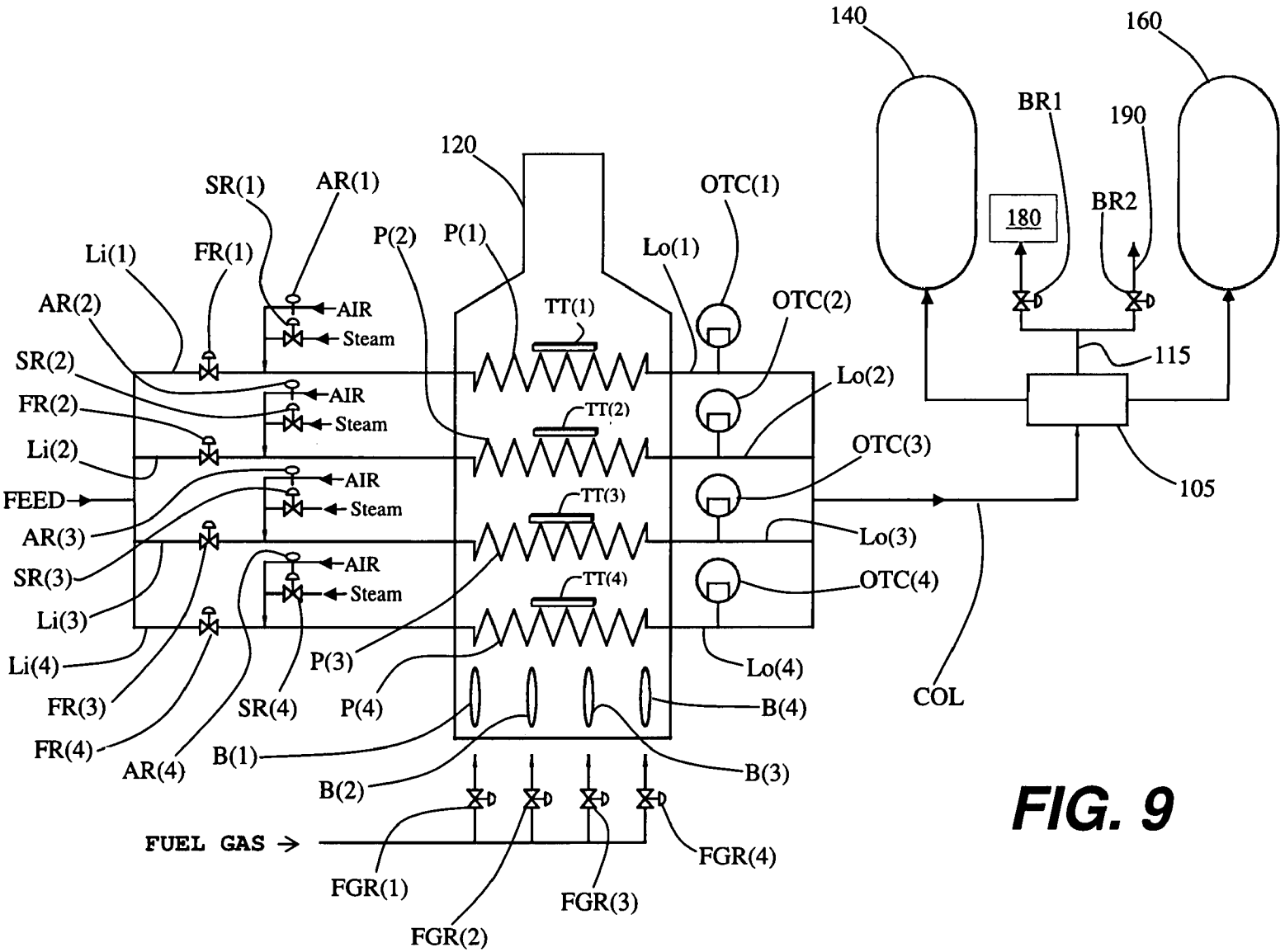
FIG. 9 shows a not-to-scale schematic layout of a second embodiment of the present invention.

FIG. 9 shows a not-to-scale schematic layout of a second embodiment of the present invention in which a 4-way valve 105 is deployed downstream of a tube furnace 120. During normal operation the four-way valve 105 is set to direct the feed in combined output line COL to one of a pair of delayed coke drums 140 and 160. As explained previously, the delayed coke drums 140 and 160 operate in continuous-batch mode. The tube furnace 120 is multi-pass tube furnace made up of a plurality of passes, in this example of a tube furnace there are four passes, i.e., passes P(1) through P(4). It should be understood that the number of passes in the tube furnace 120 can vary, can be more than four or can be less than four. Explanation of the part numbers and labels shown in FIG. 9 are found in Table 1.

Still referring to the second embodiment, furnace 120 continues operating so long as the number of passes that meet or exceed their allocated SIFR does not fall below a predetermined number. For example, for a furnace with 4 passes and a predetermined number of 2, the furnace is automatically put into global-decoke mode (i.e., decoke of all four passes) once 3 passes are undergoing online steam spalling. For example, for a furnace with 6 passes and a predetermined number of 4, and P(1), P(3) and P(5) have associated FIR(1), FIR(3) and FIR(5) respectively less than SIFR(1), SIFR(3) and SIFR(5) the furnace is automatically put into global-decoke mode; this would occur, for example, if P(1, 3, and 5) are undergoing online steam spalling.

Still referring to the second embodiment, FIG. 11 shows logic blocks 320 and 340 that describe a series of logic steps for controlling the heating of feed in tube furnace 120 via input lines Li(1 through N) so long as the number of passes that meet or exceed their allocated SIFR does not fall below a predetermined number. Blocks 320 and 340 can be respectively used in place of blocks 240 and 260 in FIG. 6 thereby causing FIG. 6 to speak to the second embodiment of the present invention. Explanation of the part numbers and labels shown in FIG. 11 are found in Table 1.

Figure 12:
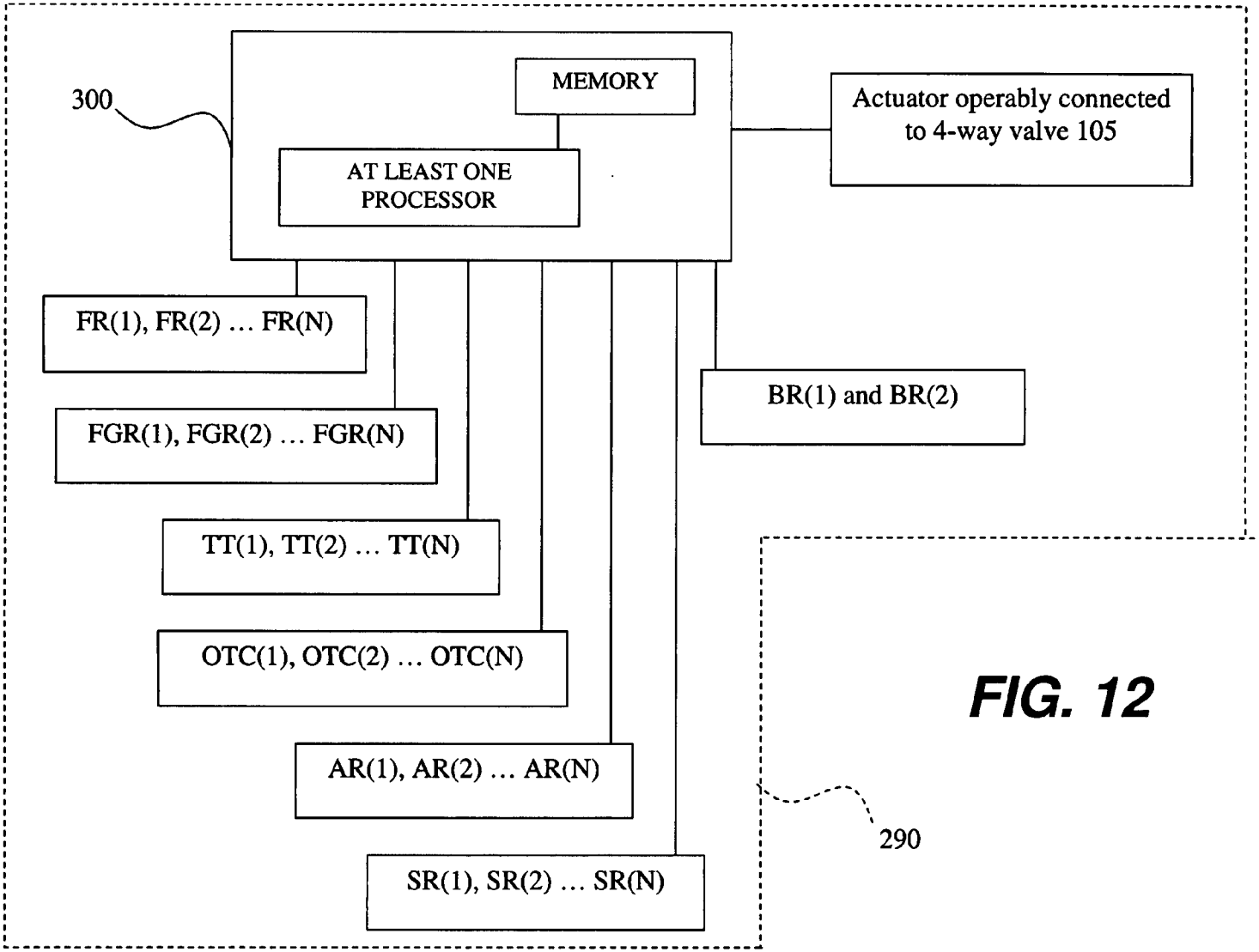
FIG. 12 shows a schematic diagram of a control system according to the present invention.

Still referring to the second embodiment, FIG. 12 shows a schematic diagram in which control system 290 further includes flow regulators BR1 and BR2. Flow regulators BR1 and BR2 are in hardwire and/or wireless communication with main-controller 300. In this second embodiment the main-controller 300 includes at least one processor and sufficient memory to perform a control algorithm, wherein the main-controller 300 operates in response to the control algorithm, wherein the control algorithm includes the logic steps necessary to selectively operate the four-way valve 105 and other parts of the control system 290 in order to perform, for example, the steps defined in blocks 320 and 340 as shown in FIG. 11.

Figure 13:
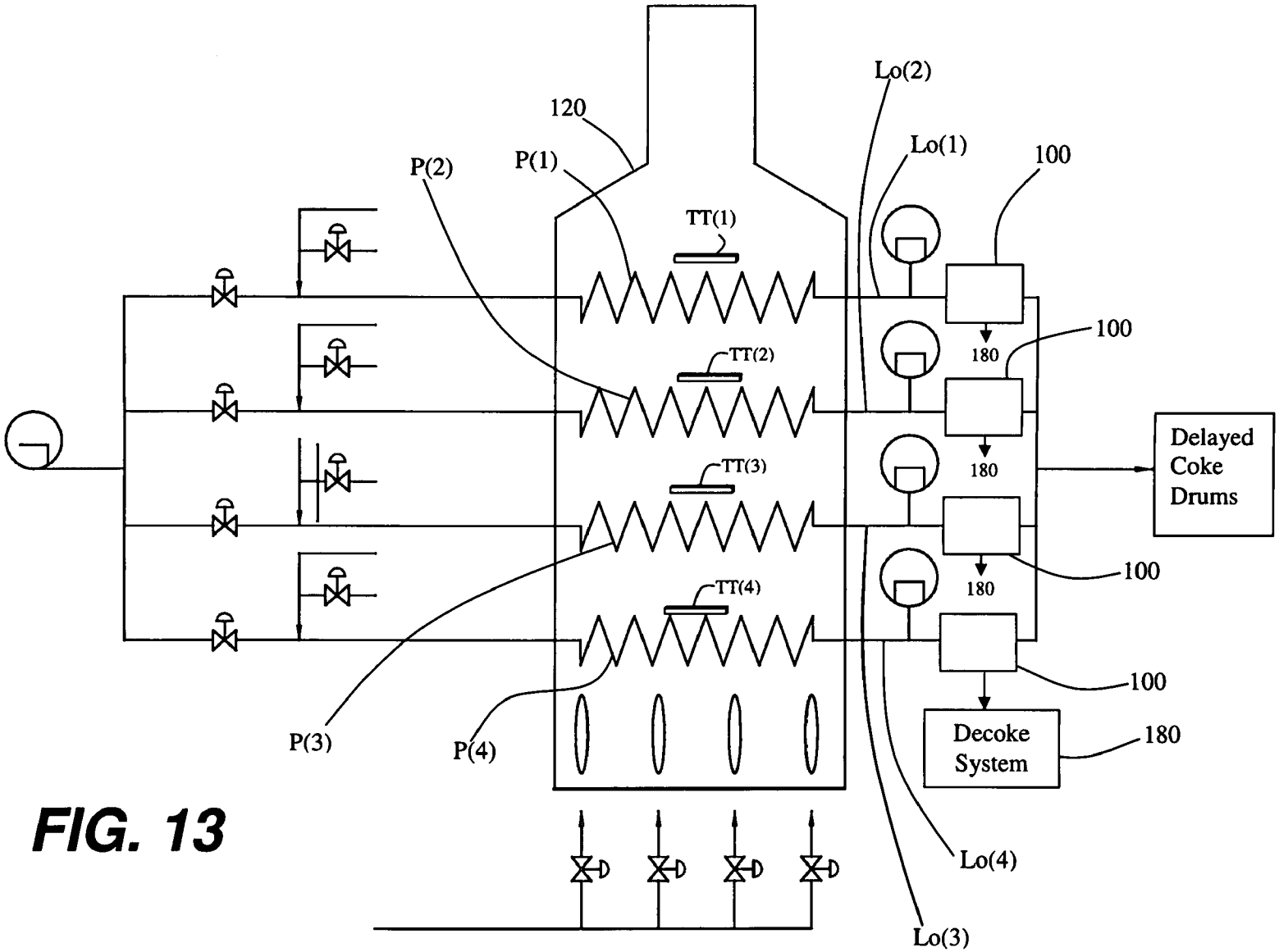
FIG. 13 shows a not-to-scale schematic layout of a further embodiment according to the present invention.

With reference to FIG. 13, which speaks to a third embodiment of the present invention, a three-way valve 100 is located on every output line Lo(1 through N) thereby allowing each pass to be decoked separately.

Figure 14:
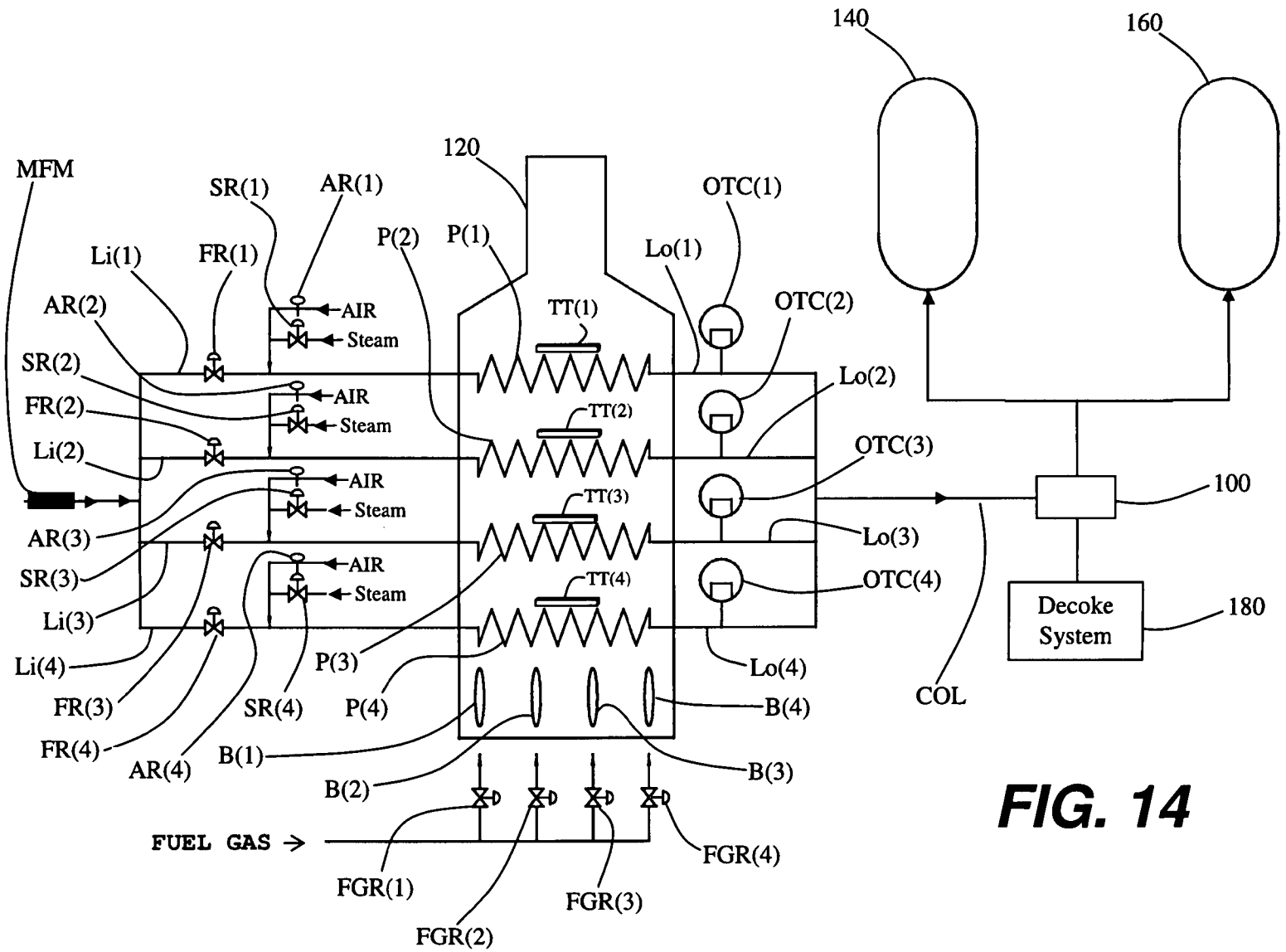
FIG. 14 shows a not-to-scale schematic layout of a further embodiment according to the present invention.
Figure 15:
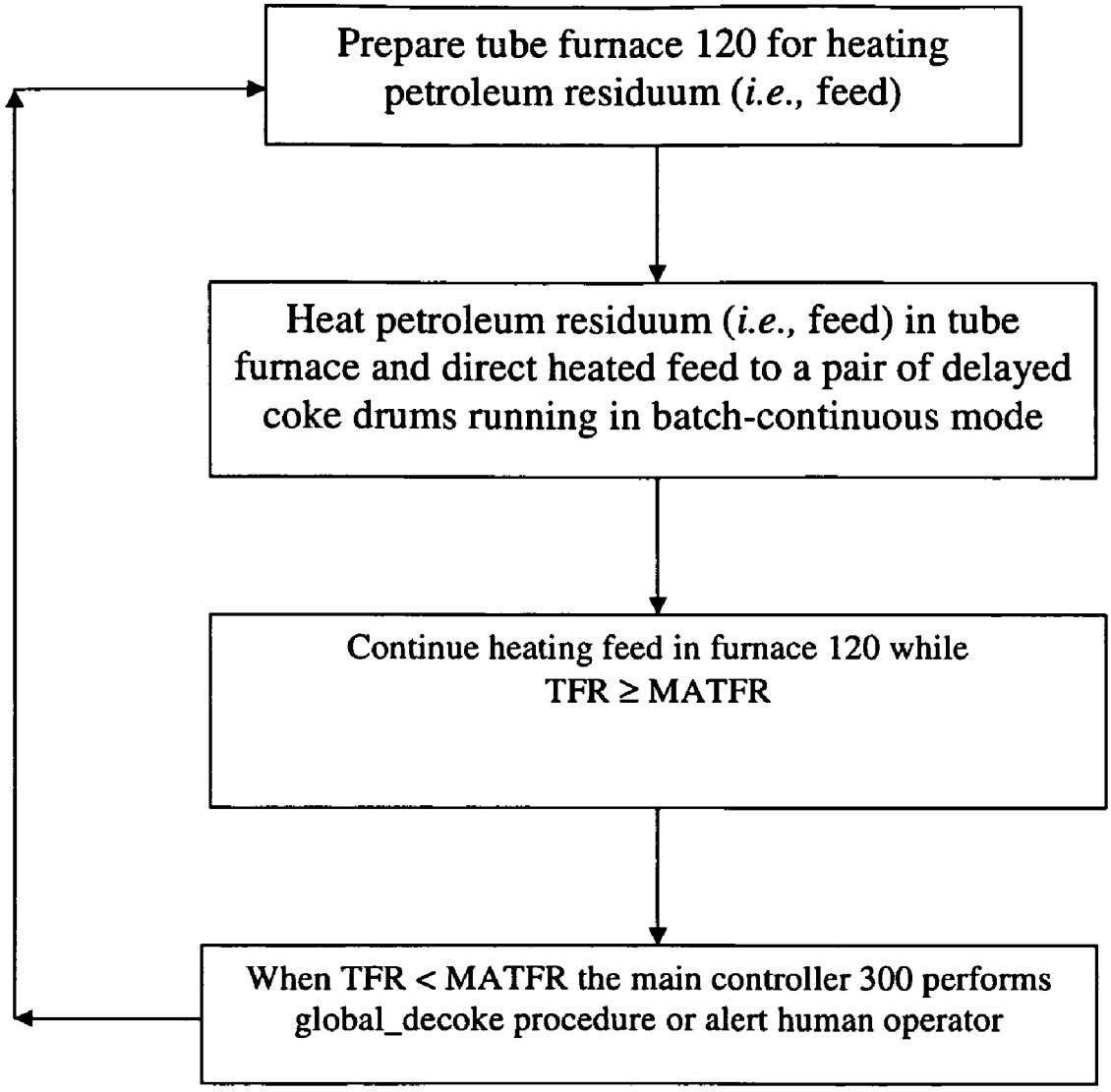
FIG. 15 shows a flow chart depicting a further aspect of the present invention.
Figure 16:
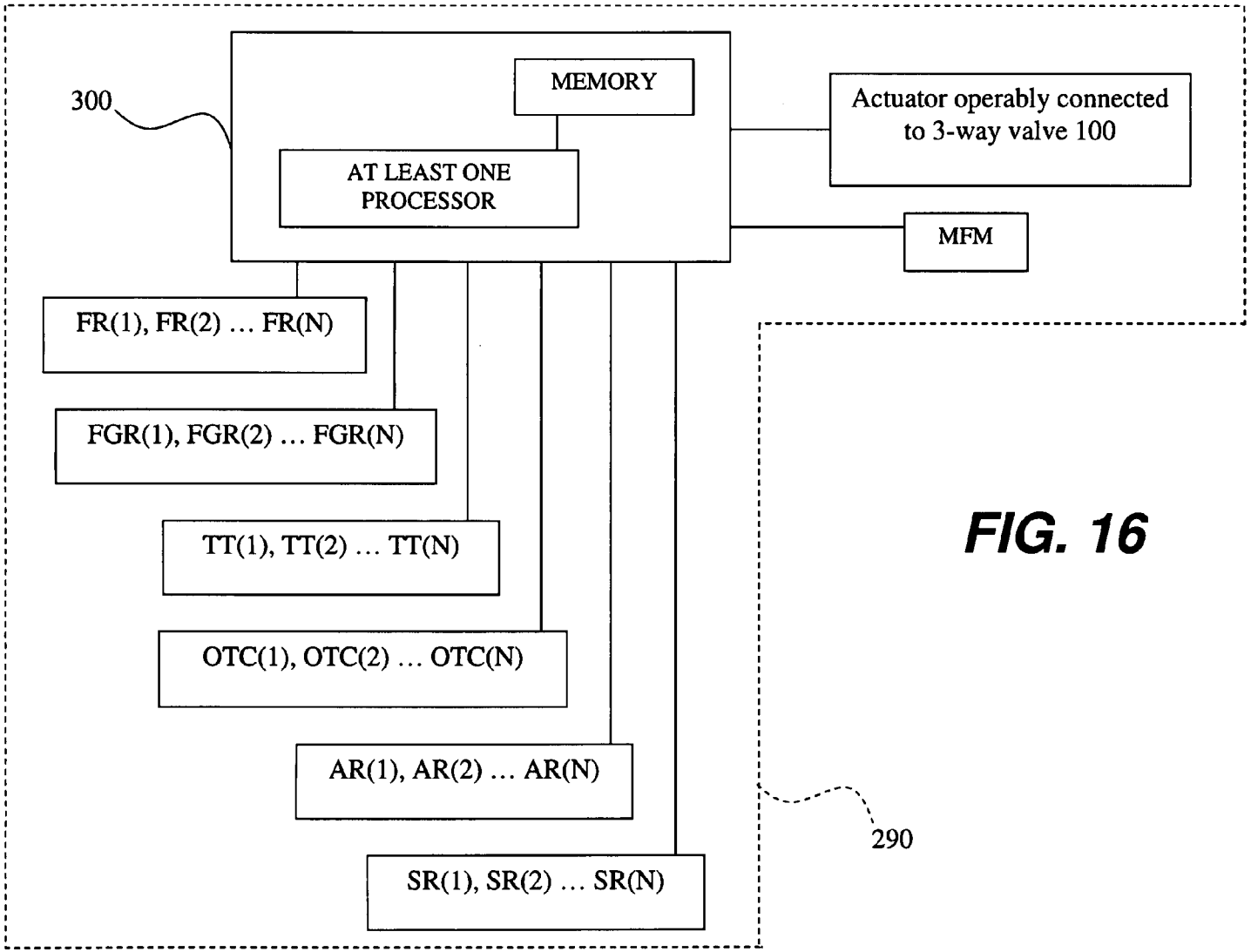
FIG. 16 shows a schematic diagram of a control system according to the present invention.

In a fourth embodiment, a main flow meter MFM (see FIG. 14) on main input line carrying petroleum residuum (feed) is used to aid the main controller 300 in determining decoke schedules for P(1 through N). In more detail, the main flow meter MFM is operably linked by means of hardwire and/or wireless communication with the main controller 300 (see FIG. 16); the main flow meter MFM measures the total flow rate TFR. When TFR<MATFR the main controller 300 performs a global-decoke procedure or alerts the on duty human operator (see FIG. 15). Explanation of the part numbers and labels shown in FIGS. 14-16 are found in Table 1.

Figure 17:
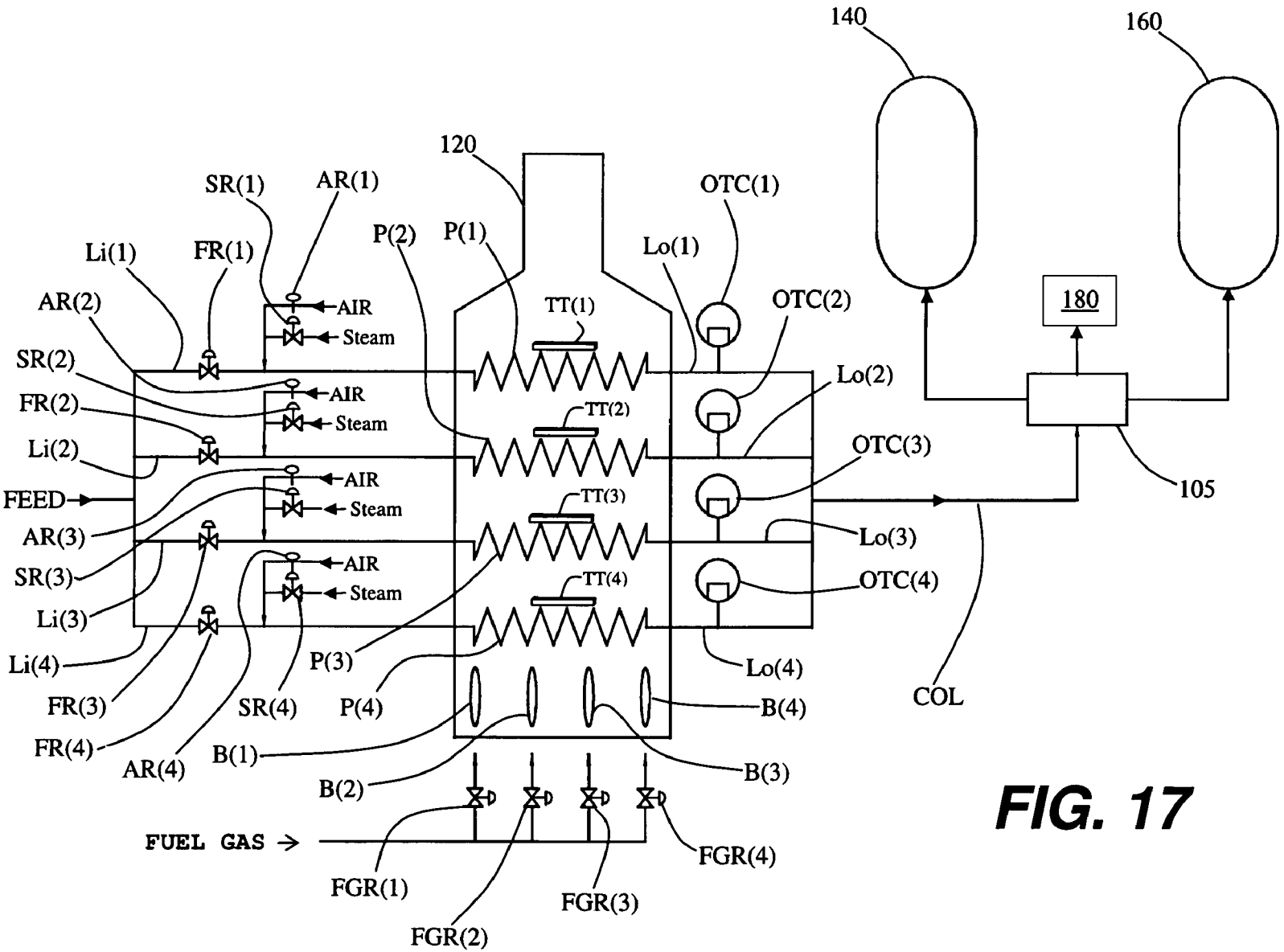
FIG. 17 shows a not-to-scale schematic layout of a further embodiment according to the present invention.

FIG. 17 shows a not-to-scale schematic layout of a fifth embodiment of the present invention in which a 4-way valve 105 is deployed downstream of a tube furnace 120. During normal operation the four-way valve 105 is set to direct the feed in combined output line COL to one of a pair of delayed coke drums 140 and 160. As explained previously, the delayed coke drums 140 and 160 operate in continuous-batch mode. The tube furnace 120 is shown made up of plurality of passes, in this example of a tube furnace there are four passes, i.e., passes P(1) through P(4). It should be understood that the number of passes in the tube furnace 120 can vary, can be more than four or can be less than four. Explanation of the part numbers and labels shown in FIG. 17 are found in Table 1.

Referring still to the fifth embodiment, and FIGS. 17 and 18 in particular, furnace 120 continues operating so long as the number of passes that meet or exceed their allocated SIFR does not fall below a predetermined number. More specifically, FIG. 18 shows logic blocks 360 and 380 that describe a series of logic steps for controlling the heating of feed in tube furnace 120 via input lines Li(1 through N) so long as the number of passes that meet or exceed their allocated SIFR does not fall below a predetermined number. Blocks 360 and 380 can be respectively used in place of blocks 240 and 260 in FIG. 6 thereby causing FIG. 6 to speak to the fifth embodiment of the present invention. Explanation of the part numbers and labels shown in FIG. 18 are found in Table 1.

Still referring to the fifth embodiment of the present invention, FIG. 18 shows a schematic diagram in which control system 290 further includes operable communication, which can be by hardwire and/or wireless communication, between the main-controller 300 and four way valve 105. In this embodiment, the main-controller 300 includes at least one processor and sufficient memory to perform a control algorithm, wherein the main-controller 300 operates in response to the control algorithm, wherein the control algorithm includes the logic steps necessary to selectively operate the four-way valve 105 and other parts of the control system 290 in order to perform, for example, the steps defined in blocks 360 and 380 as shown in FIG. 18.

Figure 19:
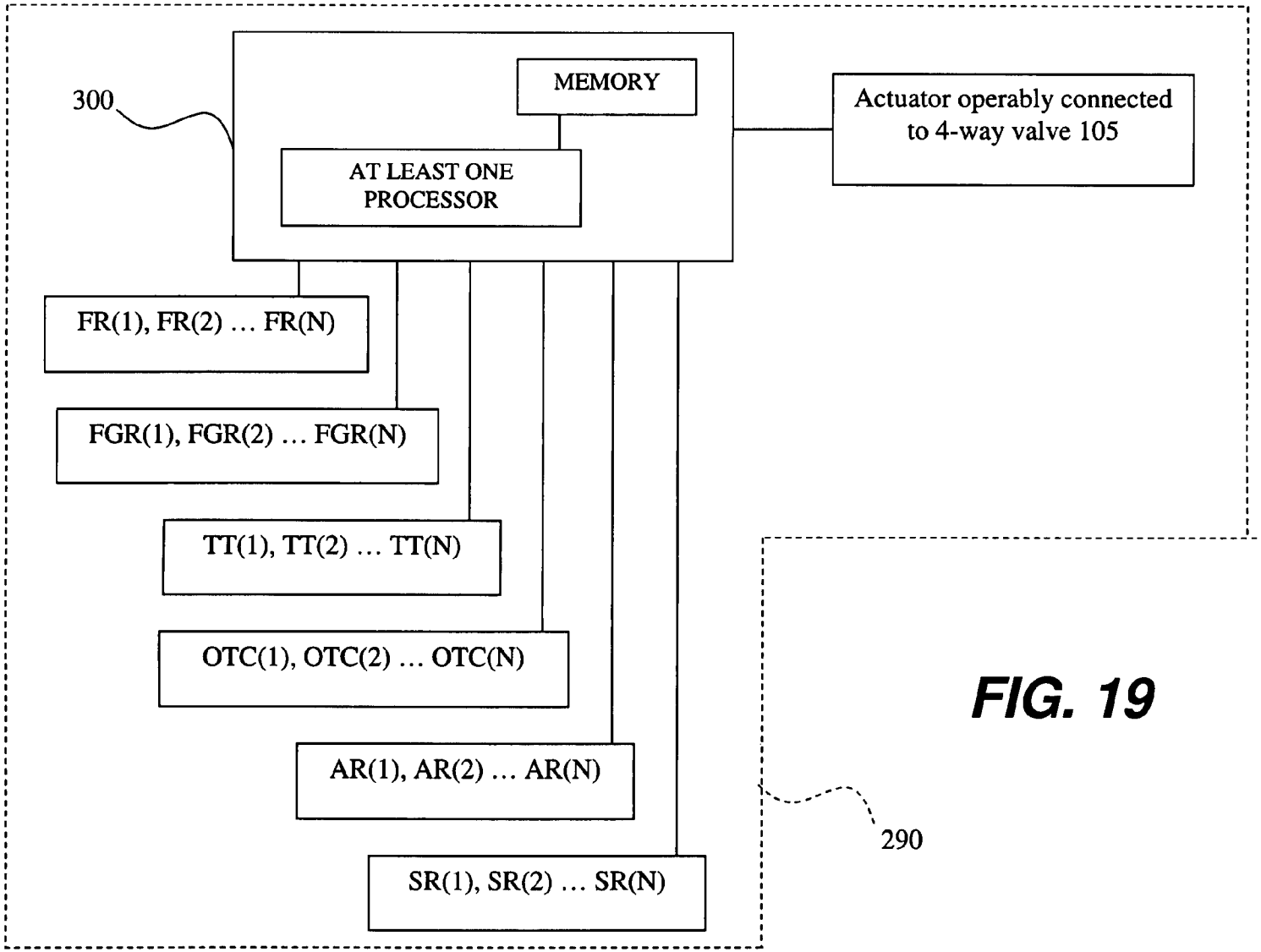
FIG. 19 shows a schematic diagram of a control system according to the present invention.

Still referring to the fifth embodiment, FIG. 19 shows a schematic diagram in which the main-controller 300 includes a processor and sufficient memory to perform the logic steps necessary to selectively operate the four-way valve 105 and other parts of the control system 290 in order to perform, for example, the steps defined in blocks 360 and 380 as shown in FIG. 18.

In a further embodiment of the present invention, a control system 290 for performing a global-decoke of a tube furnace 120 comprising a plurality of passes P(1 through N), said control system comprises:

a main-controller 300, wherein said main-controller comprises at least one processor and sufficient memory to perform a control algorithm, wherein the main-controller operates in response to said control algorithm, wherein said main-controller is operably connected to: a plurality of feed regulators FR(N), a plurality of feed gas regulators FGR(N), a plurality of air regulators AR(N), a plurality of steam regulators SR(N), a plurality of tube temperature measurement devices TT(N), a plurality of output temperature measurement devices OTC(N), and a 3-way valve, wherein a plurality of feed outlet temperature FOT(N) is respectively monitored by the plurality of output temperature measurement devices OTC(N), a plurality of furnace tube temperatures FTT(N) is respectively monitored by the plurality of tube temperature measurement devices TT(N), a plurality of feed input rates FIR(N) is respectively monitored by the plurality of feed regulators FR(N), and wherein said main-controller in response to said control algorithm communicates a control signal to the 3-way valve to direct flow output along a combined output line to a decoke system 180 when a predetermined number of the plurality of feed input rates FIR(N) do not meet or exceed a corresponding plurality of set input feed rates SIFR(N) whereupon said main controller 300 performs a global-decoke procedure.

In a still further embodiment of the present invention, a control system 290 for performing a global-decoke of a tube furnace 120 comprising a plurality of passes P(1 through N), said control system comprises:

a main-controller 300, wherein said main-controller comprises at least one processor and sufficient memory to perform a control algorithm, wherein the main-controller operates in response to said control algorithm, wherein said main-controller is operably connected to: a plurality of feed regulators FR(N), a plurality of feed gas regulators FGR(N), a plurality of air regulators AR(N), a plurality of steam regulators SR(N), a plurality of tube temperature measurement devices TT(N), a plurality of output temperature measurement devices OTC(N), and a 4-way valve, wherein a plurality of feed outlet temperature FOT(N) is respectively monitored by the plurality of output temperature measurement devices OTC(N), a plurality of furnace tube temperatures FTT(N) is respectively monitored by the plurality of tube temperature measurement devices TT(N), a plurality of feed input rates FIR(N) is respectively monitored by the plurality of feed regulators FR(N), and wherein said main-controller in response to said control algorithm communicates a control signal to the 4-way valve to direct flow output along a combined output line to a decoke system 180 when a predetermined number of the plurality of feed input rates FIR(N) do not meet or exceed a corresponding plurality of set input feed rates SIFR(N) whereupon said main controller 300 performs a global-decoke procedure.

In a further embodiment of the present invention, a control system 290 for performing a global-decoke of a tube furnace 120 comprising a plurality of passes P(1 through N), said control system comprises:

a main-controller 300, wherein said main-controller comprises at least one processor and sufficient memory to perform a control algorithm, wherein the main-controller operates in response to said control algorithm, wherein said main-controller is operably connected to: a plurality of feed regulators FR(N), a plurality of feed gas regulators FGR(N), a plurality of air regulators AR(N), a plurality of steam regulators SR(N), a plurality of tube temperature measurement devices TT(N), a plurality of output temperature measurement devices OTC(N), flow regulator BR(1) for directing fluid to a decoke system 180, flow regulator BR(2) in a coke bypass line, and a 4-way valve, wherein a plurality of feed outlet temperature FOT(N) is respectively monitored by the plurality of output temperature measurement devices OTC(N), a plurality of furnace tube temperatures FTT(N) is respectively monitored by the plurality of tube temperature measurement devices TT(N), a plurality of feed input rates FIR(N) is respectively monitored by the plurality of feed regulators FR(N), and wherein said main-controller in response to said control algorithm communicates a control signal to the 4-way valve to direct flow output along a combined output line to a decoke system 180 via BR(1) when a predetermined number of the plurality of feed input rates FIR(N) do not meet or exceed a corresponding plurality of set input feed rates SIFR(N) whereupon said main controller 300 performs a global-decoke procedure.

In a further embodiment of the present invention, a control system 290 for performing a global-decoke of a tube furnace 120 comprising a plurality of passes P(1 through N), said control system comprises:

a main-controller 300, wherein said main-controller comprises at least one processor and sufficient memory to perform a control algorithm, wherein the main-controller operates in response to said control algorithm, wherein said main-controller is operably connected to: a plurality of feed regulators FR(N), a plurality of feed gas regulators FGR(N), a plurality of air regulators AR(N), a plurality of steam regulators SR(N), a plurality of tube temperature measurement devices TT(N), a plurality of output temperature measurement devices OTC(N), a main flow meter MFM on a main input line and a 3-way valve, wherein a plurality of feed outlet temperature FOT(N) is respectively monitored by the plurality of output temperature measurement devices OTC(N), a plurality of furnace tube temperatures FTT(N) is respectively monitored by the plurality of tube temperature measurement devices TT(N), a plurality of feed input rates FIR(N) is respectively monitored by the plurality of feed regulators FR(N), wherein total flow rate TFR into the tube furnace is measured by said main flow meter MFM, and wherein said main-controller in response to said control algorithm communicates a control signal to the 3-way valve to direct flow output along a combined output line to a decoke system 180 when TFR is less than MATFR whereupon said main controller 300 performs a global-decoke procedure.

The invention being thus described, it will be evident that the same may be varied in many ways by a routineer in the applicable arts. Such variations are not to be regarded as a departure from the spirit and scope of the invention and all such modifications are intended to be included within the scope of the claims. For example, the method and apparatus according to the present invention can be applied to performing global-decoke on any refinery petrochemical furnace, e.g., a multi-pass tube oil furnace immediately upstream of a vacuum distillation unit; likewise for any other type of multi-pass tube oil furnace immediately upstream of, for example, a crude unit or a petroleum cracker unit, etc.

I claim:

1. A method for decoking a tube furnace used in combination with delayed coke drums, the method comprising the steps of:

feeding a hydrocarbon feed to a tube furnace comprising a plurality of passes, wherein each pass comprises a furnace tube including a hydrocarbon feed input line and a feed output line having a computer-controlled, automatic three-way valve located therein upstream of a combined output line leading to the delayed coke drums;

monitoring the performance of each pass;

maintaining hydrocarbon feed to each pass while the number of passes that meet or exceed an allocated performance rate does not fall below a predetermined number;

initiating decoking of the passes separately or together when the number of passes that meet or exceed the allocated performance rates falls below the predetermined number thereby generating decoking waste;

diverting the decoking waste via the three-way valves to a decoke waste system;

completing the decoking of the passes; and redirecting hydrocarbon feed to the tube furnace to provide heated hydrocarbon feed to the combined output line and the downstream coke drums via the three-way valves.

2. The method of claim 1, wherein a control system is provided to determine when the number of passes that meet or exceed the allocated performance rate falls below the predetermined number by obtaining: (1) feed input rate data from feed regulators associated with the feed input lines; and (2) temperature data from tube temperature measurement devices and output feed temperature measurement devices; and then comparing said data to a predetermined acceptable temperature and feed rate.

3. The method of claim 2, wherein a main-controller is provided to control the feed input rate into the passes by selectively operating the feed regulators, wherein the feed input rate is determined based on data obtained from the feed regulators, tube temperature measurement devices, and output feed temperature measurement devices, wherein feed is increased when the feed input rate is below a predetermined minimum and temperatures are within predetermined temperature tolerances.

4. The method of claim 3, wherein the main-controller controls the furnace tube temperature of the furnace tubes based on the temperature data obtained from the tube temperature measurement devices, wherein tube temperature of a furnace tube is decreased if the tube temperature exceeds a predetermined maximum temperature.

5. The method of claim 4, wherein the furnace tube temperature of a furnace tube is increased if: (1) the output feed temperature is below a predetermined acceptable temperature tolerance; (2) the furnace tube temperature is below a predetermined maximum temperature; and (3) the feed input rate is at or above a predetermined minimum.

6. The method of claim 5, wherein the furnace tube temperature of a furnace tube is increased and the feed input rate is increased if: (1) the output feed temperature is below a predetermined acceptable tolerance; (2) the furnace tube temperature is below a predetermined maximum; and (3) the feed input rate is below a predetermined minimum.

7. The method of claim 6, wherein the furnace tube temperature of a furnace tube is decreased if: (1) the output feed temperature is above a predetermined acceptable tolerance; (2) the furnace tube temperature is below a predetermined tolerance; and (3) the feed input rate is at or above a predetermined minimum.

8. The method of claim 7, wherein the feed input rate is increased if: (1) the output feed temperature is above a predetermined acceptable temperature; (2) the furnace tube temperature is below a predetermined acceptable tolerance; and (3) the feed input rate is below a predetermined minimum.

9. The method of claim 8, wherein the furnace tube temperature of a furnace tube is decreased if: (1) the output feed temperature is above a predetermined acceptable temperature; (2) the furnace tube temperature is at or near a predetermined maximum; and (3) the feed input rate is greater than or equal to a predetermined minimum.

10. The method of claim 9, wherein the furnace tube temperature of a furnace tube is decreased and decoking is initiated if: (1) the output feed temperature is roughly greater than or equal to a predetermined temperature tolerance; (2) the furnace tube temperature is roughly greater than or equal to a predetermined maximum; and (3) the feed input rate is roughly greater than or equal to a predetermined minimum.

* * * * *